United States Patent [19]

Capes et al.

[11] Patent Number: 4,648,962

[45] Date of Patent: Mar. 10, 1987

[54] METHOD OF BREAKING DOWN CHEMISORPTION BOND OF CLAY-CONTAINING HEAVY OIL WATER EMULSIONS

[75] Inventors: Charles E. Capes, Ottawa; Richard D. Coleman, Orleans; William L. Thayer; Ira E. Puddington, both of Ottawa, all of Canada

[73] Assignee: Canadian Patents and Development Limited, Ottawa, Canada

[21] Appl. No.: 830,906

[22] Filed: Feb. 18, 1986

Related U.S. Application Data

[63] Continuation of Ser. No. 660,299, Oct. 12, 1984, which is a continuation-in-part of Ser. No. 411,021, Aug. 24, 1982, abandoned.

[30] Foreign Application Priority Data

Jul. 29, 1981 [CA] Canada ..... 382750

[51] Int. Cl.[4] ..... C10G 1/00; B01D 17/04

[52] U.S. Cl. ..... 208/188; 208/177; 208/426; 44/23; 44/24; 44/1 R; 44/1 SR; 210/708; 264/117

[58] Field of Search ..... 208/8 R, 8 LE, 177, 208/188; 44/23, 24, 1 R, 1 SR, 1 A; 210/708; 264/117

[56] References Cited

U.S. PATENT DOCUMENTS

| | | | |
|---|---|---|---|
| 1,887,774 | 11/1932 | Meinzer | 208/188 |
| 1,919,655 | 7/1933 | Hoffman et al. | 208/188 |
| 1,935,725 | 11/1933 | Perl et al. | 208/188 |
| 2,323,524 | 7/1943 | Down Jr. | 208/188 |
| 3,272,742 | 9/1966 | Polishuk | 208/188 |
| 3,296,117 | 1/1967 | Ross et al. | 208/188 |
| 3,637,464 | 1/1972 | Walsh et al. | 264/117 |
| 3,665,066 | 5/1972 | Capes et al. | 23/314 |
| 4,153,419 | 5/1979 | Clayfield et al. | 44/24 |
| 4,234,320 | 11/1980 | Verschuur | 44/23 |
| 4,239,718 | 12/1980 | Dudt | 246/117 |
| 4,249,910 | 2/1981 | Masologites et al. | 44/24 |
| 4,270,927 | 6/1981 | Burk, Jr. et al. | 23/314 |
| 4,284,413 | 8/1981 | Capes et al. | 23/314 |
| 4,309,301 | 6/1980 | Nicol et al. | 44/24 |
| 4,360,422 | 11/1982 | Oka et al. | 44/124 |
| 4,396,489 | 8/1983 | Burke | 208/177 |
| 4,417,976 | 11/1983 | Sander et al. | 208/188 |
| 4,457,827 | 7/1984 | Chung et al. | 208/8 LE |

OTHER PUBLICATIONS

"Recovery of Water and Bitumen for the Athabasca Oil Sand Tailings Pond", Technology, Jan.-Mar. 1981, Montreal, pp. 131-133.

The Condensed Chem. Dictionary, 10th Ed., C. Hawley, p. 479, Van Nostrand Reinhold Co., NY.

*Primary Examiner*—John Doll

*Assistant Examiner*—Helane Myers

*Attorney, Agent, or Firm*—Murray and Whisenhunt

[57] ABSTRACT

Persistent chemisorption bonds of clay solids in clay-containing heavy oil and water emulsions, from oil sands, heavy oil or conventional oil wells, are broken down by mixing the emulsion with an aqueous mixture of coal particles so that the mixture has a suspension density in the range 1 to 50 weight % solids. The coal particles have a particle size in the range 5 to 100 μm so that occluded hydrophilic, inorganic solids are separable from a substantial portion of the hydrophobic, carbonaceous substances of the coal. The mixing of the emulsion with the aqueous suspension of coal particles is continued until agglomerates are formed comprising essentially carbonaceous components of the coal and the heavy oil thereby breaking down the chemisorption bonds by interdependantly dissociating carbonaceous components of the coal and heavy oil from the clay solids and other hydrophilic, inorganic solids and water from the coal and heavy oil. The agglomerates are separated from the dissociated clay solids and other hydrophilic, inorganic components and then volatile components of the agglomerates may be thermally or otherwise extracted from them.

2 Claims, 2 Drawing Figures

Figure 1:
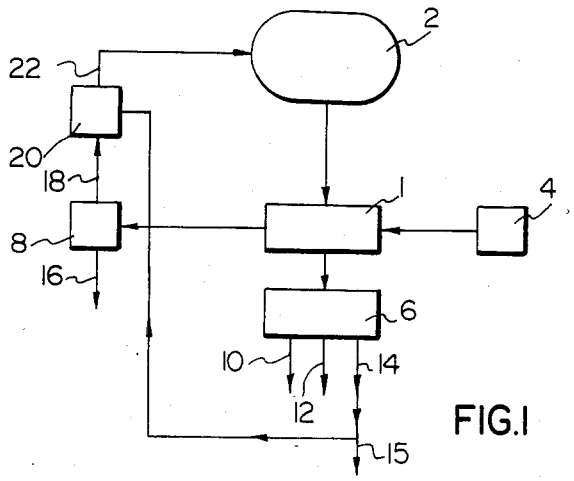

METHOD OF BREAKING DOWN CHEMISORPTION BOND OF CLAY-CONTAINING HEAVY OIL WATER EMULSIONS

This application is a continuation of application Ser. No. 660,299, filed 10/12/84, now abandoned, which was a continuation-in-part application of application Ser. No. 411,021, filed 8/24/82, now abandoned.

This invention is a continuation-in-part-application of application Ser. No. 411,021, filed Aug. 24, 1982, now abandoned.

This invention relates to a method of breaking down chemisorption bonds of clay solids in clay-containing, heavy oil and water emulsions.

Persistent clay-containing, petroleum and water emulsions are produced, for example, in the extraction of oil from Canadian oil sands, either in the currently predominant surface mining methods or in the future use of in-situ extraction by steam-injection and other methods. Oil from conventional oil wells suffer from the same problem. In the surface mining process, oil is extracted from the oil sands by what is known as the hot-water process. In the steam-injection process, steam is pumped into the deposit causing the crude petroleum to become less viscous, as a result of the elevated temperature. The less viscous crude petroleum is then pumped out of adjacent wells as a clay-containing, crude petroleum and water emulsion. Steam-injection serves to render the oil more fluid, as well as rejecting much of the particulate inorganic material originally present therein. Fire flooding and other methods may also cause clay-containing, crude petroleum and water emulsions to be present.

Unfortunately, the steam-injection methods do not remove all of the particulate inorganics and add additional inorganic impurities in the form of water. Dispersed throughout the emulsion are fine particles of clay and other inorganic materials. These materials contribute to the stabilization of the emulsion, by nitrogen, sulphur and oxygen elements therein forming chemisorption bonds with clay solids, which will not spontaneously separate completely. If this emulsion were sent to a distillation tower as is, it could be likely to cause processing difficulties, for example froth formation inside the tower. In a paper entitled "Comparison of Surface Tar Sand Extraction Processes" by P. F. Irminger et al, presented at AIChE, 1983, in Denver, Colo., under V. Oleophilic Separation, bitumen containing fine clay and fine sand particles is upgraded by adding a solvent to reduce the viscosity of the bitumen and induce separation by centrifuging. It is because of the expense and difficulty of such current emulsion-breaking procedures that there is need for a viable method for breaking clay-containing, crude petroleum and water impurity emulsions.

It has already been proposed in U.S. Pat. No. 4,153,419, dated May 8, 1979, "Agglomeration of Coal Fines", E. J. Clayfield et al, to agglomerate coal using an emulsion of crude oils, bituminous fractions, deasphalted residual fractions, lubricating oils and gas oils. Clayfield et al makes no mention of breaking down chemisorption bonds of clay solids in clay-containing, heavy oil and water emulsions.

U.S. Pat. No. 3,984,287, dated Oct. 5, 1976, "Apparatus for Separating Organic Material From Particulate Tar Sands And Coal And Agglomeration Of The Particulate Residue", F. W. Meadus et al, there is described a different process for the extraction of bitumen from oil sands wherein bitumen is solvent extracted and the residue is agglomerated to facilitate removal of the residue from the solvent laden with bitumen. In this process the solvent laden with bitumen retains a small amount of intractable solids of the order of 0.4 weight % to greater than 1 weight % depending on the type of oil sands and the operating conditions. Expressed on the bitumen component alone, this value varies from about 1.3 to 4 weight %. Because of adverse effects on the catalyst, coke quality, etc., refineries usually require the solids content of crude oils to be not more than 1 weight %. While the bulk of the solids in this solvent extraction process are formed into spherical agglomerates bonded by water, the non-settling solids that occur in the extracted bitumen consist mostly of oil wetted clay particles. The hydrophobic nature of these solids prohibits them from being agglomerated with the main body of the water wetted material. The organic constituents absorbed by chemisorption on the surface of solids in oil sands as well as heavy crudes have been the subject of much study in recent years. These studies cover the broad areas of settling, emulsion formation, and emulsion stability, as well as removal and characterization of the organic constituents. Absorbed organic material some of which is not extractable with solvents reduces the bitumen recovery in what is known as the Hot Water processing plants. Because of their adverse effect on settling of clay minerals, these compounds together with asphaltic acids are responsible for the existence of tailings ponds.

Lean oil sand feeds obtained at the interface between the rich oil sands and the overburden are particularly high in hydrophobic clay. When the organic phase of such feed material is recovered, the concentrate contains a high amount of clay solids regardless of the process used. For mine run feed a froth flotation concentrate from the Hot Water process contains up to 10 weight % solids and about 50 weight % water. The froth is diluted with a suitable solvent to facilitate the removal of solids and water, which is accomplished by two stages of centrifuging, with a filtering operation between the stages.

Thus a high proportion of the fines remaining in the bitumen concentrates obtained from processes for bitumen extraction from tar sands are made up mostly of highly peptized hydrophobic clay particles so that a heavy oil and water emulsion is formed containing clay particles forming chemisorption bonds.

According to the present invention there is provided a method of breaking down chemisorption bonds of clay solids in clay-containing, heavy oil and water emulsions, comprising:

(a) agitating, while forming a suspension having a density in the range of 1 to 50 weight % solids, from the emulsion and an aqueous mixture of coal particles, the coal particles having a particle size in the range of 5 to 100 μm so that at least a substantial portion of the carbonaceous solid components of the coal, in a hydrophobic condition, are separable from at least a substantial portion of the hydrophilic, inorganic solids of the coal and water, (b) continuing the agitation of the suspension until agglomerates are formed from at least substantial portions of the carbonaceous components of the coal and the heavy oil with the heavy oil acting as a bridging liquid between carbonaceous components of the coal, thereby breaking down the said chemisorption bonds by interdependantly dissociating carbonaceous components of the coal and heavy oil from the clay solids and other hydrophilic, inorganic solids and water of the coal and the heavy oil, and then (c) isolating the agglomerates from the dissociated clay solids and other hydrophilic, inorganic solids and water.

Volatile components may be extracted from the agglomerates.

Volatile components may be flashed from the agglomerates and refined into tars and heavy oil fractions and synthetic crude leaving a coke or char.

At least a portion of the coke or char may be used for steam raising in a steam raising plant.

Steam from the steam raising plant may be used for removing the heavy oil, in the form of heavy crude petroleum oil, from the ground by steam injection.

The dissociated inorganic solids and water may be fed to a water treating apparatus to remove dissociated hydrophilic, inorganic solids from the water, and the water may be utilized in the steam raising plant.

Breaking down chemisorption bonds of clay solids in clay-containing, heavy oil and water emulsions, according to the present invention, will interdependantly achieve two objectives:

(i) it will separate carbonaceous components of the emulsion from clay, other inorganic impurities and water therein, and (ii) it will separate carbonaceous components of the coal from inorganic impurities and water therein.

In an industrial process, carbonaceous components of the heavy oil may be flashed from the carbonaceous solid components of the coal in the agglomerates and then refined and processed in the usual manner. The residual carbonaceous solid components of coal may then be burnt as fuel and any traces of carbonaceous components of the heavy oil remaining therewith will add to the calorific value of the carbonaceous components of the coal. In different processes the agglomerates may be thermally treated to remove carbonaceous components in the form of hydrocarbons not only from heavy oil remaining with the coal but also those that were originally present in the coal.

Figure 2:
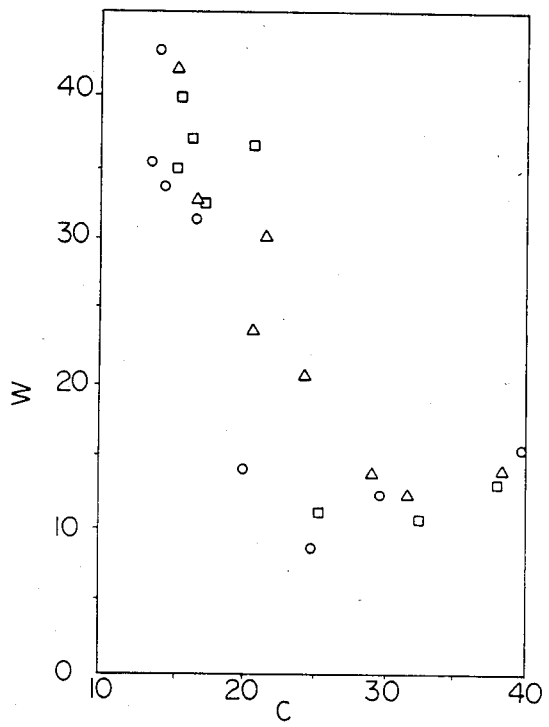

In the accompanying drawings which illustrate, by way of example, an embodiment of the present invention, FIG. 1 is a flow diagram of a method of separating carbonaceous components from clay and other hydrophilic, inorganic solids and water in an emulsion containing heavy oil using coal particles to break down the chemisorption bonds of the clay particles, and FIG. 2 is a graph of the weight % water (w) trapped in the agglomerated product (wet basis) plotted against the weight % of carbonaceous components of the crude petroleum (c), on a dry basis of the feed coal.

In FIG. 1 there is shown a method of separating carbonaceous components from clay and other hydrophilic, inorganic solids and water in an emulsion containing heavy oil using coal particles to break down the chemisorption bonds of the clay solids, comprising (a) agitating, while forming a suspension having a density in the range of 1 to 50 weight % solids, from the emulsion, from source 2, and an aqueous mixture of coal particles, from source 4, in an agglomerating apparatus, the coal particles having a particle size in the range 5 to 100 μm so that at least a substantial portion of the carbonaceous solid components of the coal, in a hydrophobic condition, are separable from at least a substantial portion of the hydrophilic, inorganic solids of the coal and water, (b) continuing the agitation of the suspension in the agglomerating apparatus 1 until agglomerates are formed from at least a substantial portion of the carbonaceous components of the coal and the crude petroleum, thereby, breaking down the chemisorption bonds by interdependantly dissociating carbonaceous components of the coal and heavy oil from the clay solids and other hydrophilic, inorganic solids and water of the coal and the heavy oil, then (c) isolating the agglomerates in the agglomerating apparatus from the dissociated clay solids and other hydrophilic, inorganic solids and water, and then, in this embodiment, (d) extracting, in an agglomerate processing apparatus 6, volatile components from the agglomerates.

The dissociated clay solids and other hydrophilic, inorganic solids and water, from which the agglomerates have been isolated, may be fed to a water treating apparatus 8.

The agglomerating apparatus 1 may comprise one conventional mixing device in the form of a high shear mixing device such as, for example, a conventional turbine mixer, provided that the residence time for the crude petroleum to agglomerate the coal particles is tolerable. If this residence time and the intensively mixed volume is too great for one mixing device then, for example, three conventional mixing devices may be provided with the second and the third mixing devices being relatively lower blade speed intermediate intensity mixing devices.

The heavy oil may be obtained from a source 2 which may be, for example, an oil well from which oil is removed by pumping water therein or by steam injection, or bitumen extracted from oil sands by the Hot Water process or in situ mining by steam-injection or other enhancement methods.

The particulate coal may be from a source 4 which may, for example, be a waste fine coal, a coal-in-water slurry output from a conventional coal wet grinding apparatus or a pulverized dry coal output from a conventional coal dry pulverizing apparatus. It will be appreciated that even when a pulverized dry coal output is used, some water is usually trapped in the coal particles.

The isolated agglomerates may be thermally or otherwise treated in a number of ways to release the volatile components therefrom. The agglomerate processing apparatus 6 may, for example, comprise an apparatus wherein the volatile components of the carbonaceous components of the heavy oil are flashed from the coal particles of the agglomerates, by heat in a vacuum and then refined in a conventional manner. If the heavy oil is bitumen from oils and then, after being flashed from the agglomerates, the volatile components may be refined into tars and heavy oil fractions 10 and synthetic crude 12 leaving a coke or char 14, at least a portion of which may be used for steam raising in a steam raising plant 20 and any remaining coke or char 15 may be sold as a product.

The water treating apparatus 8 may be, for example, a settling pond, an ultrafiltration apparatus or any apparatus or combination of apparatus that is used to remove dissociated clay and other hydrophilic inorganic solids 16 from the water and treat boiler feed water. The inorganic dissociated clay and other hydrophilic inorganic solids 16 are disposed of while the water 18 may be utilized in, for example, the steam raising plant 20 and recycled as steam 22 when, for example, heavy oil is being removed from the ground by steam injection.

The following describes the experimental procedures and analytical techniques used in, and the experimental results obtained from, an investigation of the possible application of the present invention to break down the chemisorption bonds in a clay-containing, oil and water emulsion with coal particles. The experiments described concern an emulsion produced by steam-injection in a pilot heavy oil recovery plant in Western Canada.

The crude oil was in two phases—an organic phase and an aqueous phase. These phases were separated by scooping the organic layer off the aqueous layer. Each phase was then analysed by (1) a gravimetric approach based on weight loss at 110° C. and at 750° C. and (2) the Soxhlet extraction—Dean and Stark method. Results of these analyses are presented in the following Table 1.

The coal was in the form of tailings from a bituminous coal preparation plant, and contained approximately 37 weight % ash.

passed through the screen with the water. The agglomerates were returned to the blender for a wash in approximately 500 $cm^3$ of fresh water, with mixing at 110 v for three minutes and at 30 v for two minutes. The blender contents were poured onto the screen a second time to isolate the agglomerates. The aqueous phase containing clay and other hydrophilic, inorganic solids and wash were combined and placed in an oven to dry overnight at 110° C. A small sample of the agglomerates was taken off the screen for determination of the heavy oil, water and solids levels by Soxhlet extraction—Dean and Stark analysis. The weights of the dried hydrophilic, inorganic solids and the agglomerates were recorded and a small amount was taken from each fraction for clay and other hydrophilic, inorganic solids (mainly ash) analysis by firing on a bunsen burner followed by a muffle furnace at 750° C. overnight. A material balance was then conducted on the overall experiment.

As mentioned before, the feed emulsions were added in varying concentrations and methods. In a first method, only the heavy oil contained in the emulsions was used as the bridging liquid for the carbonaceous components of the coal. In a second method, emulsions

TABLE I

SUMMARY OF ANALYSIS OF EMULSION SAMPLES

| Sample | Height of Organic Phase/Height of Aqueous Phase, as layers in original barrel | Phase | Method of Analysis* | Composition (wt %) Water | Oil | Solids |
|---|---|---|---|---|---|---|
| A-4 | 3.5" oil | Organic | 1 | 34.78 | 65.22 | 0.00 |
| (Barrel #1) | 10.0" water | Organic | 2 | 23.91 | 74.09 | 0.00 |
| | | Aqueous | 1 | 98.98 | 0.89 | 0.13 |
| | | | 2 | 99.47 | 0.47 | 0.06 |
| | | Combined calculated analysis of barrel contents | ** | 80.37 | 19.56 | 0.04 |
| C-5 | 1.25" oil | Organic | 1 | 25.65 | 74.17 | 0.18 |
| | 14.75" water | | 2 | 18.79 | 80.58 | 0.63 |
| | | | 2 | 19.67 | 79.84 | 0.49 |
| | | Aqueous | 1 | 99.54 | 0.28 | 0.17 |
| | | | 2 | 97.61 | 2.26 | 0.13 |
| | | | 2 | 97.89 | 2.08 | 0.03 |
| | | Combined calculated analysis of barrel contents | ** | 91.45. | 8.38 | 0.17 |
| A-3 | 1.0" oil | Organic | 1 | 31.21 | 68.67 | 0.13 |
| | 11.75" water | | 2 | 17.34 | 82.66 | 0.00 |
| | | | 2 | 22.55 | 77.03 | 0.42 |
| | | Aqueous | 1 | 99.22 | 0.59 | 0.19 |
| | | | 2 | 99.65 | 0.28 | 0.07 |
| | | | 2 | 99.62 | 0.32 | 0.06 |
| | | Combined calculated analysis of barrel contents | ** | 93.19 | 6.74 | 0.06 |

*Method #1 refers to the gravimetric method and method #2 refers to the Soxhlet extraction - Dean and Stark analysis.
**Calculation based on results obtained by Dean and Stark Extraction method of analysis.

The following agglomeration procedure was used throughout the tests. In a one-liter Waring blender, 500 $cm^3$ of a ten weight percent coal slurry was placed. Various types and amounts of heavy oil were added and mixed at 110 v for two to eight minutes followed by one lower speed mixing at 30 v for two minutes. The resulting agglomerates of carbonaceous solids of the coal and the heavy oil and dissociated clay and other hydrophilic, inorganic solids and water of the coal and heavy oil were poured onto a 100-mesh screen where the agglomerates remained on the screen and the clay and other hydrophilic inorganic solids, such as ash material, were added to the slurry, allowed to mix and then a small amount of a light oil was added to complete the agglomeration. In a third method, an emulsion and the light oil were pre-mixed before addition to the slurry in the same light oil to total oil ratio as the lowest and highest concentrations conducted by the second method. The last method of oil addition consisted of elevating the temperature of the slurry to 85° C. and using only the emulsion as the oil source. All of these methods proved successful in that agglomeration occurred. The following Table II summarized the different methods of addition.

TABLE II

| EMULSION TYPE | EXPERIMENT NOS. | METHOD OF TREATMENT+ |
|---|---|---|
| A-4 | 1,5–8 | Add heavy oil emulsion and mix for 2 min. Add light oil, mix for 2 min. |
| A-4 | 2,3 | Pre-mix light oil and heavy oil emulsion, add mixture and mix for 8 min. |
| A-4 | 4 | Heat slurry to 85° C. and add heavy oil emulsion, mix for 3 min. |
| A-3 | 9,12,14–16 | Add heavy oil emulsion and mix for 1 min. Add light oil and mix for 2 min. |
| A-3 | 11 | Add heavy oil emulsion and mix for 10 min. |
| A-3 | 13 | Pre-mix heavy oil emulsion and light oil, add and mix for 5 min. |
| A-3 | 10 | Heat slurry to 85° C., add heavy oil emulsion and mix for 3 min. |
| C-5 | 18,20,22–24 | Add heavy oil emulsion and mix for 1 min. Add light oil and mix for 2 min. |
| C-5 | 21 | Heat slurry to 85° C. and add emulsion. Mix for 2.5 min. |
| C-5 | 17,19 | Pre-mix heavy oil emulsion and light oil. Add mixture and mix for 10 min. |
| A-4,A-3 C-5 AQUEOUS PHASE | 25–32 | Add aqueous phase to slurry and mix for 3 min. No light oil required. |

+Mixing times noted are for high speed blending. All experiments were mixed at low speed following the stated period of high speed mixing.

In the following Table III, the results of the upgrading of the heavy oil and water emulsion have been presented. The effect of oil content of the product agglomerates on the amount of retained water is shown.

ments is presented in the following Table IV. In this table, the percentage recovery of carbonaceous components is also presented. Carbonaceous components in this case refers to all of the heavy oil added and the combustible fraction of the coal.

TABLE III

UPGRADING OF THE HEAVY OIL EMULSION (OIL RICH PHASE)

| OIL TYPE | EXPERIMENT NO. | WEIGHT % OIL db-feed | db-agglomerates by calculation | db-agglomerates by analysis | % $H_2O$ IN AGGLOMERATES (w.b.) |
|---|---|---|---|---|---|
| A-4 | 1 | 13.55 | 21.18 | 19.85 | 35.34 |
| | 2 | 14.08 | 21.44 | 18.11 | 43.01 |
| | 3 | 14.60 | 21.31 | 22.54 | 33.73 |
| | 4 | 16.78 | 26.35 | 19.58 | 31.40 |
| | 5 | 20.19 | 30.25 | 27.04 | 14.27 |
| | 6 | 24.93 | 39.35 | 37.81 | 8.69 |
| | 7 | 29.68 | 44.83 | 40.42 | 12.39 |
| | 8 | 39.86 | 58.63 | 58.21 | 13.80 |
| A-3 | 9 | 15.37 | 23.24 | 21.55 | 34.97 |
| | 10 | 15.48 | 25.29 | 13.25 | 39.83 |
| | 11 | 16.24 | 25.13 | 22.67 | 37.00 |
| | 12 | 17.09 | 25.67 | 19.82 | 32.39 |
| | 13 | 20.56 | 30.78 | 24.04 | 36.47 |
| | 14 | 25.39 | 39.24 | 33.00 | 11.04 |
| | 15 | 32.31 | 47.23 | 49.10 | 10.76 |
| | 16 | 37.84 | 56.19 | 53.49 | 13.16 |
| C-5 | 17 | 15.22 | 22.65 | 21.31 | 41.88 |
| | 18 | 16.77 | 27.07 | 35.20 | 32.73 |
| | 19 | 20.71 | 31.54 | 33.51 | 23.78 |
| | 20 | 21.62 | 32.67 | 32.68 | 30.02 |
| | 21 | 24.43 | 38.26 | 31.22 | 20.68 |
| | 22 | 29.15 | 44.43 | 43.43 | 13.98 |
| | 23 | 31.66 | 46.81 | 55.90 | 12.43 |
| | 24 | 38.25 | 53.58 | 60.56 | 14.20 |

The upgrading of the coal as a function of the heavy oil concentrations for the various emulsion and treat-

TABLE IV

UPGRADING OF COAL (USING THE HEAVY OIL RICH PHASE or CRUDE PETROLEUM EMULSION)

| OIL TYPE | EXPT. NO. | % HYDROPHILIC, INORGANIC SOLIDS (ASH) IN AGGLOMERATES (MOISTURE AND OIL-FREE BASIS) | % RECOVERY OF COAL | % RECOVERY OF TOTAL CARBONACEOUS COMPONENTS | % HYDROPHILIC, INORGANIC SOLIDS (ASH) IN TAILINGS (MOISTURE-FREE BASIS) | % HYDROPHILIC, INORGANIC SOLIDS (ASH) IN FEED COAL FROM MASS BALANCE |
|---|---|---|---|---|---|---|
| A-4 | 1 | 7.43 | 93.41 | 94.57 | 88.54 | 36.64 |
| | 2 | 9.05 | 94.98 | 95.90 | 90.81 | 37.11 |
| | 3 | 9.81 | 95.81 | 96.58 | 91.39 | 35.50 |
| | 4 | 11.51 | 89.41 | 91.63 | 81.56 | 36.72 |
| | 5 | 8.61 | 93.46 | 95.00 | 87.17 | 34.73 |
| | 6 | 9.26 | 93.26 | 95.20 | 88.64 | 38.34 |
| | 8 | 13.56 | 94.97 | 96.95 | 90.26 | 38.14 |
| A-3 | 9 | 9.47 | 94.96 | 95.95 | 90.61 | 36.95 |
| | 10 | 9.52 | 87.51 | 89.97 | 79.52 | 36.71 |
| | 11 | 8.31 | 94.11 | 95.32 | 89.51 | 37.03 |

TABLE IV-continued

| UPGRADING OF COAL (USING THE HEAVY OIL RICH PHASE or CRUDE PETROLEUM EMULSION) | | | | | | |
|---|---|---|---|---|---|---|
| OIL TYPE | EXPT. NO. | % HYDROPHILIC, INORGANIC SOLIDS (ASH) IN AGGLOMERATES (MOISTURE AND OIL-FREE BASIS) | % RECOVERY OF COAL | % RECOVERY OF TOTAL CARBONACEOUS COMPONENTS | % HYDROPHILIC, INORGANIC SOLIDS (ASH) IN TAILINGS (MOISTURE-FREE BASIS) | % HYDROPHILIC, INORGANIC SOLIDS (ASH) IN FEED COAL FROM MASS BALANCE |
| | 12 | 10.77 | 94.87 | 96.01 | 90.38 | 37.38 |
| | 13 | 8.78 | 95.13 | 96.31 | 90.58 | 35.94 |
| | 14 | 10.15 | 93.55 | 95.42 | 88.63 | 37.87 |
| | 15 | 12.23 | 95.19 | 96.82 | 90.39 | 36.93 |
| | 16 | 11.65 | 94.85 | 96.79 | 90.10 | 37.24 |
| C-5 | 17 | 10.95 | 95.53 | 96.40 | 91.43 | 37.34 |
| | 18 | 8.98 | 93.93 | 95.26 | 90.41 | 39.97 |
| | 19 | 8.60 | 94.00 | 95.47 | 88.83 | 36.13 |
| | 20 | 10.93 | 94.64 | 96.02 | 90.16 | 37.72 |
| | 21 | 11.45 | 92.24 | 94.45 | 86.85 | 38.71 |
| | 22 | 10.41 | 94.23 | 96.07 | 89.54 | 37.62 |
| | 23 | 9.56 | 95.43 | 96.94 | 90.93 | 35.91 |
| | 24 | 12.11 | 95.15 | 96.79 | 90.13 | 36.44 |

The following Table V shows the results obtained when the oily aqueous phase was upgraded with coal. the widely differing heavy oil concentrations in the aqueous phase produced by the methods of analysis.

TABLE V

| RECOVERY OF HEAVY OIL FROM WATER RICH PHASE | | | | | |
|---|---|---|---|---|---|
| | | WEIGHT % HEAVY OIL | | | |
| | | | db-agglomerates | | |
| CRUDE PETROLEUM | EXPERIMENT NO. | db-feed | by calculation | by analysis | % WATER IN AGGLOMERATES |
| A-4 | 25 (a) | 8.22 | 11.71 | 31.00 | 33.50 |
| | (b) | | not possible due to conflicting numbers | | |
| | 26 (a) | 12.48 | 18.68 | 26.83 | 47.91 |
| | (b) | 6.32 | 9.27 | 26.83 | 47.91 |
| | 27 (a) | 17.52 | 25.14 | 34.15 | 40.00 |
| | (b) | 8.72 | 12.21 | 34.15 | 40.00 |
| A-3 | 28 (a) | 11.46 | 17.84 | 7.24 | 54.44 |
| | (b) | 5.23 | 7.82 | 7.24 | 54.44 |
| | 29 (a) | 10.65 | 18.80 | 7.64 | 58.67 |
| | (b) | 4.88 | 8.39 | 7.64 | 58.67 |
| C-5 | 30 | 16.11 | 24.55 | 24.69 | 51.89 |
| | 31 | 22.97 | 34.32 | 29.26 | 47.11 |
| | 32 | 26.09 | 38.75 | 46.22 | 26.99 |

(a) Results obtained by Dean & Stark - Soxhlet Extraction analysis.
(b) Results obtained by Weight Loss analysis at 110° C. and 750° C.

TABLE VI

| UPGRADING OF COAL USING THE AQUEOUS WATER RICH PHASE | | | | | | | |
|---|---|---|---|---|---|---|---|
| CRUDE PETRO-LEUM | EXPT. NO. | % HYDROPHILIC INORGANIC SOLIDS (ASH) IN AGGLOMERATES (MOISTURE AND OIL-FREE BASIS) | % RECOVERY OF COAL | % RECOVERY OF TOTAL CARBO-NACEOUS COMPONENTS | % HYDRO-PHILIC, INORGANIC SOLIDS (ASH) IN TAILINGS (DRY BASIS) | CALCU-LATED % COMBUS-TIBLES IN AQUEOUS TAILS | % HYDROPHILIC, INORGANIC SOLIDS (ASH) IN FEED COAL FROM MASS BALANCE |
| A-4 | 25 (a) | 8.97 | 95.99 | 96.43 | 91.07 | 0.25 | 33.44 |
| | (b) | | | not possible due to conflicting numbers | | | |
| | 26 (a) | 11.00 | 94.73 | 95.60 | 90.56 | 0.21 | 37.21 |
| | (b) | 10.24 | 95.04 | 95.48 | 90.56 | 0.21 | 35.62 |
| | 27 (a) | 11.27 | 95.58 | 96.75 | 89.93 | 0.14 | 35.31 |
| | (b) | 10.27 | 95.94 | 96.13 | 89.93 | 0.14 | 33.56 |
| A-3 | 28 (a) | 11.15 | 82.39 | 85.00 | 75.13 | 0.55 | 38.89 |
| | (b) | 10.34 | 83.39 | 84.56 | 75.13 | 0.55 | 37.47 |
| | 29 (a) | 12.31 | 92.50 | 93.66 | 86.43 | 0.22 | 37.88 |
| | (b) | 11.48 | 92.96 | 93.49 | 86.43 | 0.22 | 36.33 |
| C-5 | 30 | 11.04 | 92.62 | 94.13 | 88.54 | 0.29 | 37.00 |
| | 31 | 10.23 | 95.28 | 96.54 | 91.00 | 0.26 | 36.91 |
| | 32 | 7.91 | 94.49 | 96.06 | 88.93 | 0.29 | 34.43 |

(a) Results obtained by Dean and Stark - Soxhlet Extraction analysis.
(b) Results obtained by Weight Loss analysis at 110° C. and 750° C.

The following Table VI shows the results obtained when the coal was cleaned with the aqueous phase. There are two sets of data with each experiment due to The following Table VII presents the results of agglomeration of the carbonaceous substances of the coal using a petroleum light oil for comparison with Tables IV and VI.

TABLE VII

| HEAVY OIL FUEL OIL TYPE | WEIGHT % HEAVY OIL db-feed | WEIGHT % HEAVY OIL db-agglomerates | UPGRADING OF COAL USING #2 FUEL OIL: % HYDROPHILIC, INORGANIC SOLIDS (ASH) IN PRODUCT (MOISTURE AND OIL FREE BASIS | % RECOVERY OF COAL | % HYDROPHILIC, INORGANIC SOLIDS (ASH) IN TAILING (DRY BASIS) | % HYDROPHILIC, INORGANIC SOLIDS (ASH) IN FEED COAL FROM MASS BALANCE |
|---|---|---|---|---|---|---|
| #2 FUEL OIL | 5.66 | 10.64 | 10.28 | | 85.14 | 36.77 |
| | 8.39 | 12.80 | 9.50 | 93.13 | 87.30 | 36.32 |
| | 11.37 | 17.25 | 8.60 | 94.80 | 90.32 | 36.49 |
| | 14.77 | 22.61 | 7.57 | 94.51 | 89.95 | 36.10 |
| | 18.55 | 28.94 | 7.65 | 95.10 | 88.20 | 37.76 |

The different methods of analysis used were each suited to analysing a specific type of sample. For instance, the gravimetric method is generally only truly accurate in the determination of the weight loss of heavy oil or coal or tailings sample at a given temperature. The weight loss of a heavy oil at 110° C. was assumed here to be water, but it should be kept in mind that this is not necessarily the case. Along with water loss, there is a loss of the low-boiling carbonaceous components of the heavy oil as well, resulting in a higher-than-actual water level (see Table I).

The Soxhlet extraction—Dean and Stark method, in comparison, is more suited to determining the make-up of an emulsion or the water content in a sample of agglomerates than determining the heavy oil and solid level in the agglomerates. This is due to the difference in preparing an emulsion sample and an agglomerates sample for extraction, as well as the nature of the sample itself. An agglomerates sample is wrapped in several filter papers and placed in an extraction thimble to prevent the sample from washing away. As the extraction continues, some carbonaceous components of the heavy oil will be trapped in the filter papers, whereas no carbonaceous components of the heavy oil will be trapped in the single filter paper wrapping the emulsion sample. There will also be some carbonaceous components of the heavy oil trapped in the agglomerates. This trapping of carbonaceous components of the heavy oil may result in lower carbonaceous component levels than expected. Table III shows that, in general, the analysed carbonaceous component levels are lower than the calculated carbonaceous component levels based on the analysis of the starting materials used in the experiment.

Table III also presents the water content of the agglomerated coal sample, with FIG. 2 showing these results in a graphical form.

In FIG. 2,

O is for the test results of emulsion type A-4 in the tables,

□ is for the test results of emulsion type A-3 in the tables,

Δ is for the test results of emulsion type C-5 in the tables.

The main feature of these results is that the water content decreased as the concentration of the carbonaceous components of the heavy oil increases, until the concentration of the carbonaceous components of the heavy oil reaches an optimum level, when the water level starts to rise again. This is a feature common to all agglomerated coal samples. When the concentration is in the lower ranges, all of the carbonaceous components of the heavy oil wet the coal particles in a thin film and there is no excess. When the coal particles begin to coalesce, water fills in the inner-particle regions because there are not enough carbonaceous components of the crude petroleum to displace the water. But, as the concentration of the carbonaceous components of the heavy oil increases, there are more carbonaceous components of the heavy oil available to fill in these gaps. The carbonaceous components of the heavy oil force the water out, due to their hydrophobic nature. When the concentrations of the carbonaceous components of the heavy oil become even higher, the agglomerate itself becomes surrounded by these carbonaceous components. When this happens, droplets of water become trapped in this layer of carbonaceous component. As a result, the water concentration starts to increase over what it was in the preceding stage of carbonaceous components of the heavy oil. This result is shown graphically in FIG. 2.

In Tables V and VI, which deal with the aqueous phase, there are two mass balances associated with each experiment. Due to the nature of the aqueous phase, it is extremely difficult to get a sample that is truly representative of it. The phase consists mainly of relatively large sized droplets of oil dispersed throughout the water phase. Due to the small concentration of oil per unit volume, it is possible for large droplets of heavy oil to be in one sample but not in another, resulting in very large differences between the two analyses. It is for this reason that there were two mass balances conducted on the system: one for each method of analysis (i.e. one giving a high water and low heavy oil value, the other giving a low water, high heavy oil value). The true value should be somewhere between these values.

The main objective in treating the aqueous phase with coal is to interdependantly retrieve as much of the carbonaceous substances of the heavy oil and coal from the water fraction as possible. From Table VI, it can be seen that the recovery of the total carbonaceous substances (coal and oil) ranges from 93 to 97 weight % of the original material. Clay and other hydrophilic, inorganic solids (ash) levels in the tailings have the same range of values as those produced when #2 fuel oil is used (Table VII). In this case the only loss of carbonaceous substances is from the coal. Taking these two factors into account, it can be concluded that close to 100 weight % of the carbonaceous substance of the heavy oil are recovered from the aqueous phase.

Two tables are presented which indicate the upgrading of the coal using the organic and aqueous phases. They show a decrease of clay and other inorganic, hydrophilic solids (ash) in the coal from 37.1 weight % to approximately 10 weight %, in the agglomerated product. Also the recovery of carbonaceous components is generally over 95 weight % of the original combustible material. The clay and other inorganic, hydrophilic solids (ash) levels in the feed calculated from the mass balance are also shown. The close agreement between these calculated clay and other inorganic, hydrophilic solids levels and the measured value of 37.1 weight % of the clay and other inorganic, hydrophilic solids (ash) levels indicates that the analytical results were reasonably accurate since the coal mass balance closes.

The tests have shown that not only does the coal break the chemisorption bonds in the clay-containing, heavy oil and water emulsion, but interdependantly carbonaceous components of the heavy oil clean the coal to a considerable degree. The procedure can be easily reproduced and modified to handle a wide range of clay-containing, heavy oil and water emulsions and coal types. It will be appreciated that Table I shows a combined analysis for the total organic phase and aqueous phase from each barrel. These separated phases were experimented with because it was the only material available, i.e. organic and aqueous phases which had separated in transport. In a continuous plant, the feed would be closer to the combined analysis shown in Table I containing a high water content. Thus FIG. 2 shows the water content of the agglomerates to be greatly reduced by the present invention.

We claim:

1. A method of cleaning of a coal fuel being an aqueous mixture of coal particles contaminated with hydrophilic inorganic solids and enrichment thereof with a heavy oil from a clay contaminated heavy oil emulsion having persistent chemisorption bonds of clay solids, comprising:

1. forming a suspension by mixing; (a) an aqueous mixture of coal particles contaminated with occluded hydrophilic inorganic solids, with coal particle sizes in the range of 5 to 100 μm. so that at least a substantial portion of the carbonaceous components of the coal particles is in a hydrophobic condition and a substantial portion of the contaminating occluded hydrophilic inorganic solids are therefore separatable therefrom; and (b) a heavy oil and water emulsion which is contaminated with clay having persistent chemisorption bonds;
2. agitating the so-formed suspensions until agglomerates are formed from at least a substantial portion of the carbonaceous components of the coal particles, with the heavy oil forming a bridging liquid between the carbonaceous components of the coal particles, whereby the chemisorption bonds are broken and the clay of the said emulsion is separated from the said heavy oil thereof and the said hydrophilic inorganic solids are separated from the carbonaceous components of the coal particles, and whereby the said clay and the inorganic solids remain in the water phase of the suspension and are separated from the agglomerates; and
3. separating the agglomerates from the water phase of the suspension whereby a cleaned and heavy oil enriched coal fuel is recovered.

2. A method according to claim 1, wherein volatile components are removed from the agglomerates.

* * * * *